US005402918A

United States Patent [19]

Nishiyama et al.

[11] Patent Number: 5,402,918

[45] Date of Patent: Apr. 4, 1995

[54] POWDER CHARGING APPARATUS

[75] Inventors: Shigeru Nishiyama, Nara; Yasuhiro Hayashi, Osaka; Eiji Tatsumi, Akashi; Katsuji Hayata, Hirakata, all of Japan

[73] Assignee: Mita Industrial Co., Ltd., Osaka, Japan

[21] Appl. No.: 19,829

[22] Filed: Feb. 19, 1993

Related U.S. Application Data

[63] Continuation of Ser. No. 620,118, Nov. 30, 1990, abandoned.

[30] Foreign Application Priority Data

Nov. 10, 1989 [JP] Japan ..... 1-139479 U
Nov. 30, 1989 [JP] Japan ..... 1-312491
Nov. 30, 1989 [JP] Japan ..... 1-312501

[51] Int. Cl.[6] ..... B67D 1/08; B65D 47/00

[52] U.S. Cl. ..... 222/152; 222/559; 222/DIG. 1

[58] Field of Search ..... 222/333, 510, 559, 562, 222/563, 564, DIG. 1, 152; 239/650

[56] References Cited

U.S. PATENT DOCUMENTS 2,315,031 3/1943 Weigand ..... 222/559 X
2,641,476 6/1953 Keleher ..... 222/559 X
2,710,121 6/1955 Rees ..... 222/559 X
3,790,040 2/1974 Bahr et al. ..... 222/559 X

FOREIGN PATENT DOCUMENTS 1-124503 5/1989 Japan .
2101969 1/1983 United Kingdom ..... 222/559 X

*Primary Examiner*—Andres Kashnikow
*Assistant Examiner*—Kenneth R. DeRosa
*Attorney, Agent, or Firm*—Nikaido, Marmelstein, Murray & Oram

[57] ABSTRACT

A powder charging apparatus includes a low pressure chamber for accommodating a container to be charged with powder. The low pressure chamber is separable into an upper section and a lower section. A pressure reducer reduces the pressures in the low pressure chamber and the container at the same time. A pressure riser increases the pressure in the low pressure chamber. A powder supplier allows a predetermined quantity of powder to fall into the container under a difference in the pressures between inside and outside the container. The powder supplier includes a hopper having an outlet port. The container has an inlet neck portion engageable with a nozzle secured to the low pressure chamber. The nozzle is connected to the outlet port of the hopper. A buffering member is disposed at a space from the nozzle.

4 Claims, 9 Drawing Sheets

POWDER CHARGING APPARATUS

This application is a continuation of application Ser. No. 620,118, filed Nov. 30, 1990, now abandoned.

BACKGROUND OF THE INVENTION

1. Field of the invention

The present invention relates to an apparatus for charging containers with powder such as toner from a hopper by predetermined amounts. The apparatus is particularly adapted for use in an image forming apparatus.

2. Description of the Prior Art

In an image forming apparatus a toner is contained in a container of a portable type, taking the form of a bottle or a cylinder. To charge such containers with toner, the toner is packed by dropping into the containers by weight. However, this charging method is disadvantageous in that the toner is prevented from smoothly dropping into the container because (1) air is present in the container, and (2) the toner is admixed with the air in the container, thereby expanding its volume.

In order to solve these problems, a toner is dropped by weight into a container up to half of the volume of the container, and after the supplied toner is allowed to fully settle in the container, a subsequent dose of toner is given so as to fill the remaining half of volume with toner. In this way the conventional charging method requires two steps, thereby becoming a time consuming process.

The inventor has made an invention which is disclosed in Japanese Patent Laid-Open Publication 1-124503. According to this prior invention, a toner is densely packed into containers at a high speed on a simplified charging structure. The prior invention will be more particularly described by reference to FIGS. 10 and 11:

The charging apparatus illustrated in FIGS. 10 and 11 includes a low pressure chamber 71, a pressure reducer 72 for reducing the pressure in the chamber 71, and a pressure raiser 73 for raising the pressure in the chamber 71. The low pressure chamber 71 can be divided into an upper section 71*a* and a lower section 71*b*, and houses a container 1 having an inlet neck portion 2.

The low pressure chamber 71 houses a powder supplier 75, which includes a tapered nozzle 74 inserted into the inlet neck portion 2 and a toner hopper 79 connected to the nozzle 74. The toner hopper 79 includes a toner path 76, and is provided with an outlet port 79*a* connected to the nozzle 74 through a supply path 81 having a valve 82 such as a ball. The toner stored in the toner hopper 79 is caused to fall into the toner path 76 by a predetermined amount.

The container 1 is raised and lowered by a pneumatic cylinder 80, and when it is raised, the open end of the inlet neck portion 2 comes into contact with a packing or O-ring 77 fitted around the nozzle 74, thereby sealing the inlet neck portion 2.

In operation, the low pressure chamber 71 is divided into the upper section 71*a* and the lower section 71*b*, and the container 1 is placed in the lower section 71*b*. Then, the two sections 71*a* and 71*b* are in an airtight manner connected to each other. At this stage, the inlet neck portion 2 is away from the nozzle 74. The valve 82 is closed, and the low pressure chamber 71 is evacuated by the pressure reducer 72 until a desired low pressure is achieved. In this way the low pressure chamber 71 and the container 1 have the same low pressure. Then, the container 1 is raised by the pneumatic cylinder 80 until the inlet neck portion 2 of the container 1 comes into contact with the packing 77, thereby ensuring that the container 1 remains evacuated to a desired degree of vacuum. Under this condition, the valve 82 is opened so as to open the toner path 76, and simultaneously, the pressure in the low pressure chamber 71 surrounding the container 1 is increased by the pressure raiser 73. Thus, the predetermined quantity of powder is sucked into the container 1 through the toner path 76. The rise in the pressure in the low pressure chamber 71 results in equilibrium between the internal pressure and the external pressure surrounding the container 1, thereby protecting the container 1 from being broken owing to any imbalance of pressure.

Under this construction the powder in the powder supplier 75 rapidly falls into the container 1 which is kept at a vacuum, thereby ensuring that the powder does not mix with air and does not lose its substantial volume.

However, one disadvantage is that the powder sucked into the container 1 is likely to be excessively compacted because of the scarcity of air in the container 1. At the initial stage, when a relatively large difference between the pressure in the inner container 1 and that surrounding it within the low pressure chamber 75, the powder violently collides with the bottom of the inner container 1. This tends to solidify the powder into lumps. When the powder is toner for use in an image forming apparatus, the lumpy toner is fatal in that a choking problem is likely to occur in the supply of toner.

In FIG. 10, the toner stored in the hopper 79 is likely to disperse outside the hopper as indicated by the arrows X for the following reason:

The toner in the hopper 79 is rapidly sucked into the outlet port 79*a* but because of the constriction therein the air is compressed against the inside wall of the hopper 79, and drives part of the toner to burst upward as shown in FIG. 10. The dispersion outward reduces the quantity of toner to be packed into the container 1.

Furthermore, when the pressure in the container 1 is reduced to a vacuum, the toner is so violently sucked into the container 1 that it tends to disperse in the container 1 and deposit in a ringshaped gap between the outside surface of the nozzle 74 and the inside surface of the inlet neck portion 2 as shown in FIG. 11 where the reference numeral 6 denotes a toner deposit. The deposit 6 is likely to drop into subsequent fresh containers 1, and when the atmospheric pressure is introduced into the low pressure chamber 71, the deposit 6 is likely to be dispersed in the low pressure chamber 71 and stains its inside wall. When the low pressure chamber 71 is stained with toner, it is required to clean it off at times by suspending the toner charging operation, thereby consuming extra time.

SUMMARY OF THE INVENTION

The powder charging apparatus of this invention, which overcomes the above-discussed and numerous other disadvantages and deficiencies of the prior art, comprises a low pressure chamber for accommodating a container to be charged with powder, the low pressure chamber being separable into an upper section and a lower section, a pressure reducer for reducing the pressures in the low pressure chamber and the container at the same time, a pressure riser for increasing the pressure in the low pressure chamber, a powder supplier for allowing a predetermined quantity of powder to fall into the container under a difference in the pressures between inside and outside the container, wherein the powder supplier comprises a hopper including an outlet port, and wherein the container comprises an inlet neck portion engageable with a nozzle secured to the low pressure chamber, the nozzle being connected to the outlet port of the hopper and a buffering member disposed at a space from the nozzle.

In a preferred embodiment, the buffering member has a conical shape having a surface diverging downward.

In another preferred embodiment, the buffering member is movable from and toward an opening of the nozzle so as to open and close the opening.

In a further preferred embodiment, the buffering member is fixed at a space from the opening of the nozzle.

In a preferred embodiment, the buffering member has a flat shape, and is hinged to the opening of the nozzle.

In a preferred embodiment, a guide member is additionally disposed at a space from a powder outlet opening of the hopper, the guide member having a conical shape with a top diverging toward an inlet opening of the hopper.

In a preferred embodiment, the guide member has a flat bottom.

In a preferred embodiment, the guide member has an upper conical portion toward the inlet opening of the hopper, and a lower conical portion toward the outlet opening thereof.

In a preferred embodiment, the pressure riser comprises an inlet duct for introducing outside air into the low pressure chamber, a valve for opening and closing the duct, and the nozzle comprises a cover supported on a flexible support secured to the low pressure chamber, the cover being adapted to cover the opening of the nozzle.

In a further preferred embodiment, the pressure riser is connected to the low pressure chamber in its lower position.

Thus, the invention described herein makes possible the objectives of (1) providing a powder charging apparatus capable of charging a container with powder at a high speed and with high density without the possibility of making the powder lumpy, (2) providing a powder charging apparatus capable of preventing the powder from dispersing, and (3) providing a powder charging apparatus capable of protecting the inside of the low pressure chamber from becoming stained with toner.

BRIEF DESCRIPTION OF THE DRAWINGS

This invention may be better understood and its numerous objects and advantages will become apparent to those skilled in the art by reference to the accompanying drawings as follows.

DESCRIPTION OF THE PREFERRED EMBODIMENTS

Figure 1:
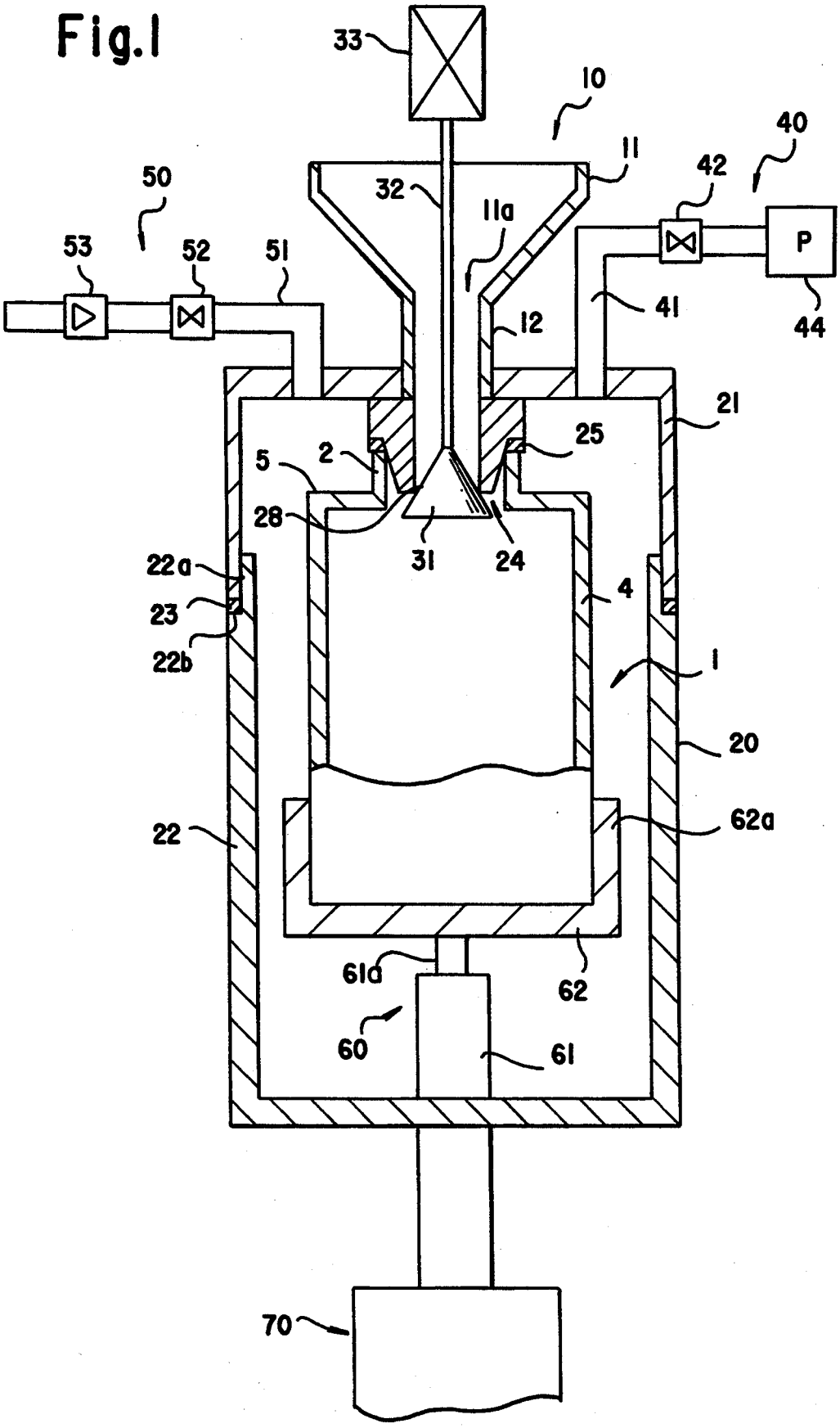
FIG. 1 is a cross-sectional view showing an embodiment according to the present invention.

The present invention will be described by way of a toner charging apparatus used in association with a copying machine:

(EXAMPLE 1)

The toner charging apparatus of the present invention includes a powder supplier 10 and a low pressure chamber 20 in which containers 1 are placed one by one for charging them with toner.

The container 1 includes a cylindrical body portion 4 and an inlet neck portion 2 projecting upward, with a shoulder portion 5 therebetween. In the illustrated embodiment, the shoulder portion 5 is flat, that is, perpendicular to the axis of the container 1 but it can be tapered.

The powder supplier 10 can be constructed with a hopper 11 for storing a predetermined quantity of toner, the hopper 11 being connected to a source of toner (not shown), a toner outlet path 11*a* a toner supply path 12 connected to the low pressure chamber 20, and a nozzle 24 situated inside the low pressure chamber 20. Under this arrangement a predetermined quantity of toner is dropped into the low pressure chamber 20 from the hopper 11 through the toner supply path 12 and the nozzle 24.

The low pressure chamber 20 is separable into an upper section 21 and a lower section 22. The lower section 22 is moved up and down by means of a pneumatic cylinder 70 so as to come into and out of engagement with the upper section 21. When the two sections 21 and 22 are joined, the low pressure chamber 20 becomes a sealed unitary chamber.

Figure 2:
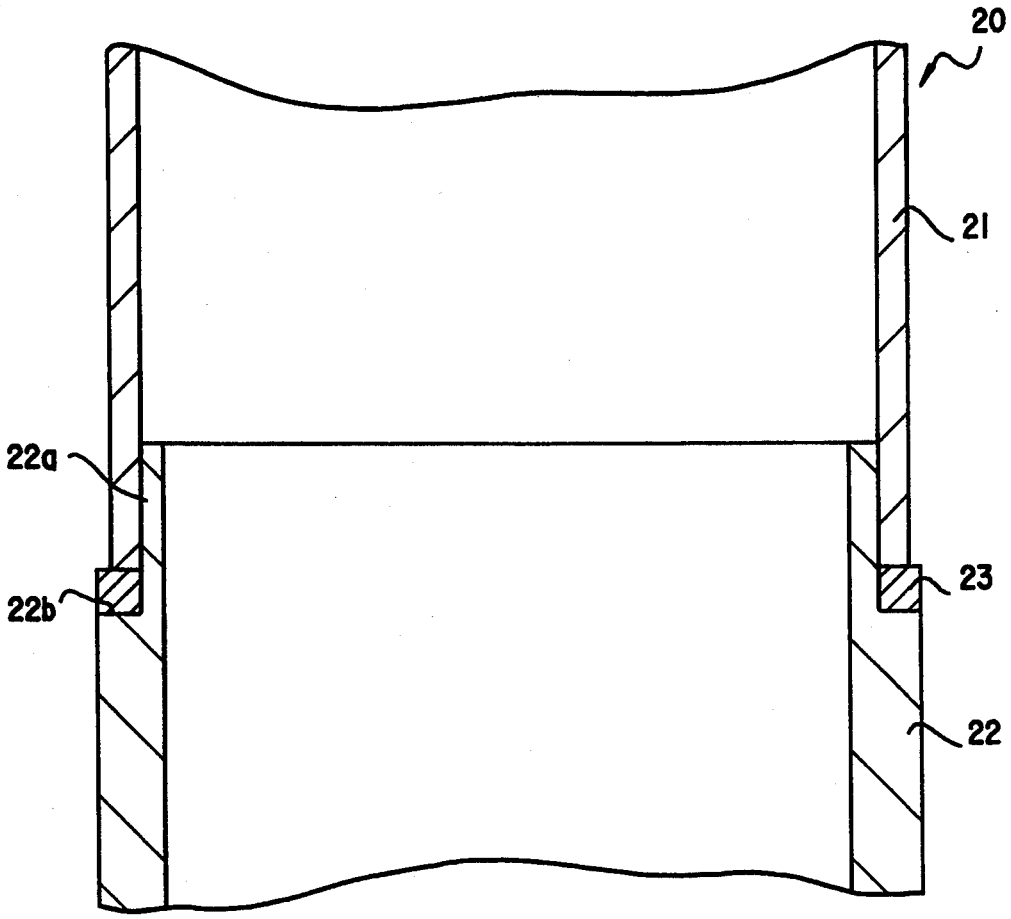
FIG. 2 is a cross-sectional view on an enlarged scale showing the Joint between an upper part and a lower part of the low pressure chamber shown in FIG. 1.

As shown in FIG. 2, the upper section 21 and the lower section 22 are joined with an elastic O-ring 23, such as a rubber ring, placed on a ring-shaped cut 22*b*, and the reference numeral 22*a* denotes an inner outside wall adapted to support the upper section 21. The ring-shaped cut 22*b* is wide enough to enable the three outside walls of the upper section 21, the lower section 22 and the O-ring 23 to be flush with one another.

When the pneumatic cylinder 70 is driven, the lower section 22 rises until it comes into engagement with the O-ring 23, thereby effecting the union between the lower section 22 and the upper section 21 in a sealing manner against the atmosphere.

Since the O-ring 23 is placed against the inner outside wall 22*a*, it is protected from being sucked into the low pressure chamber 20 when the pressure therein is reduced. This ensures that the low pressure chamber 20 is sealed against leakage.

The upper section 21 is secured to the toner supply path 12, and the nozzle 24 on the ceiling thereof so that the nozzle 24 is connected to the toner supply path 12. The top portion of the nozzle 24 is tapered downward so that it projects into the container 1 through the inlet neck portion 2. An O-ring 25 is disposed between the nozzle 24 and the inlet neck portion 2. The nozzle 24 has a toner inlet opening 28 (hereinafter called "opening") in which a conical buffering member 31 carried on a stem 32 is located. The conical buffering member 31 has a bottom portion large enough to close the opening 28 but smaller than the inside diameter of the inlet neck portion 2 when it is raised upward as shown in FIG. 1.

The stem 32 is moved up and down by means of a known driving mechanism 33. When the stem 32 is raised, the conical buffering member 31 closes the opening 28 in an airtight manner. When the stem 32 is lowered, the opening 28 is released from the conical buffering member 31 that is suspended away from the opening 28. In this way the toner in the hopper 11 is allowed to drop into the container 1.

The container 1 is moved up and down by means of a pneumatic cylinder unit 60 including a pneumatic cylinder 61 fixed to the bottom of the lower section 22, a piston 61*a* and a tray 62 having a side wall 62*a* which secures the container 1 in an upright manner on the tray 62. The container 1 is placed on the tray 62 before the upper section 21 and the lower section 22 are joined, and is moved up and down in accordance with the ascent and descent of the piston 61*a*.

After the container 1 is placed on the tray 62, the upper section 21 and the lower section 20 are connected to each other in an airtight manner with the O-ring 23 being interposed therebetween. Then, the container 1 is raised by the piston 61*a* by driving the pneumatic cylinder unit 60. In this way the inlet neck portion 2 rises until it comes into engagement with the O-ring 25. In this way the container 1 is completely sealed against the outside.

The low pressure chamber 20 is connected to a pressure reducer 40 and a pressure riser 50. The pressure reducer 40 includes a pump 44, a duct 41 and a valve 42. The pressure riser 50 includes a duct 51, a valve 52 and a rate adjusting valve 53.

Under this arrangement the toner is introduced into the container 1 in the following manner:

The driving mechanism 33 raises the stem 32 so as to enable the conical buffering member 31 to close the opening 28. A predetermined quantity of toner is placed in the hopper 11, and reserved in the hopper 11 and the toner supply path 12. The pneumatic cylinder 70 is driven so as to lower the lower section 22 away from the upper section 21. The container 1 is placed on the tray 62. After the container 1 is placed on the tray 62, the lower section 22 is raised until it is connected to the upper section 21 in an airtight manner. When the upper section 21 is connected to the lower section 22, the valve 52 is closed so that the low pressure chamber 20 is sealed against the outside. At this stage the container 1 is suspended in such a position that the inlet neck portion 2 is away from the nozzle 24, thereby allowing air to flow throughout the low pressure chamber 20 and the container 1.

The valve 42 is opened so as to reduce the pressure in the low pressure chamber 20 by the pump 44. The container 1 is evacuated at the same time. When the pressures in the low pressure chamber 20 and the container 1 are reduced to an equal degree of vacuum, the valve 42 is closed. Thus, the low pressure chamber 20 is again sealed against leakage.

At this stage, the pneumatic cylinder 61 is driven so as to raise the tray 62 until the inlet neck portion 2 comes into engagement with the O-ring 25. Thus, the inlet neck portion 2 and the opening 28 come into alignment with each other in an airtight manner, with an upper half of the buffering member 31 being situated in the opening 28. In this way the buffering member 31 closes the opening 28 as shown in FIG. 1.

Figure 3:
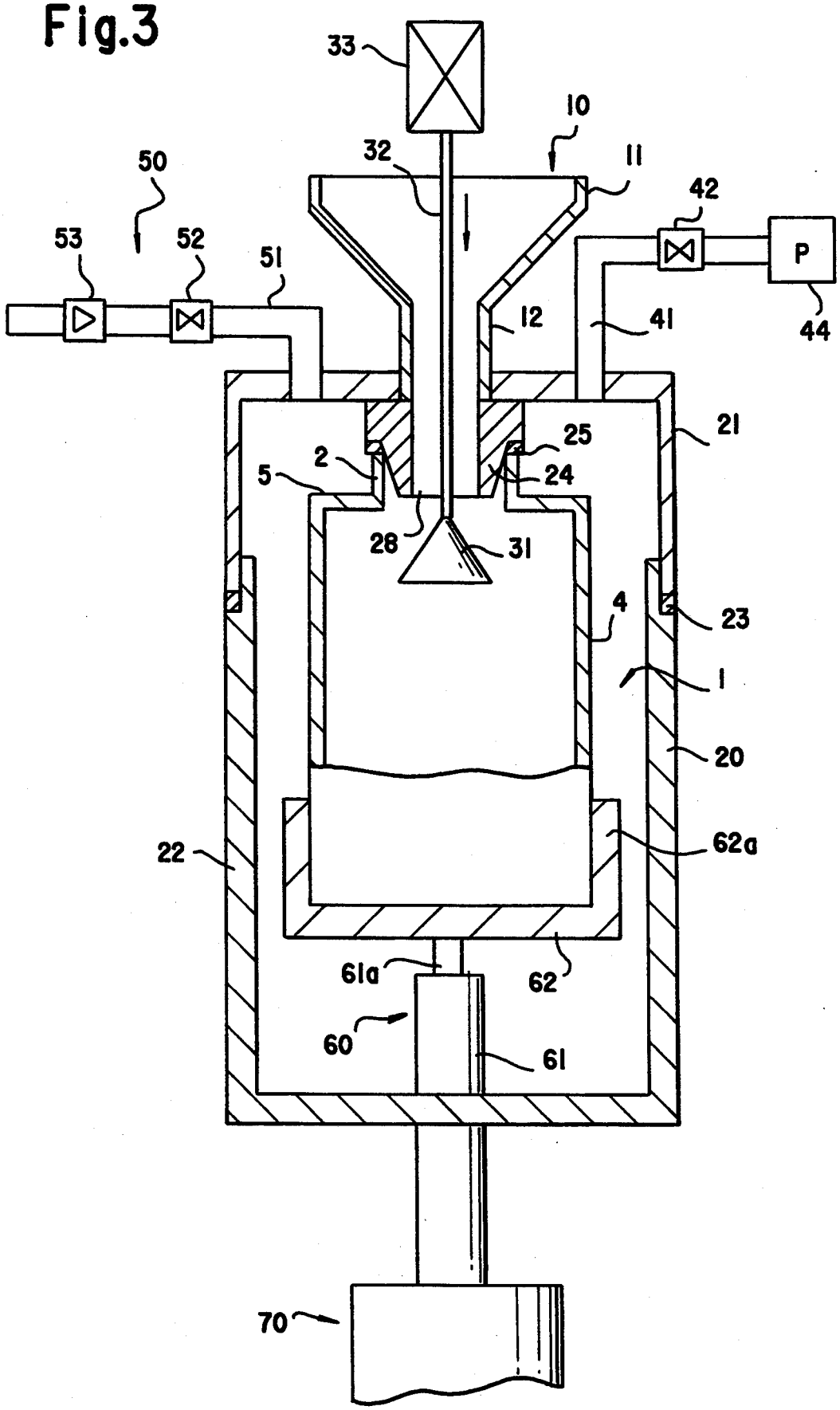
FIG. 3 is a cross-sectional view showing the operation of the powder charging apparatus.

Then, the driving mechanism 33 is driven to lower the stem 32 so that the buffering member 31 is away from the opening 28 as shown in FIG. 3. The valve 52 is opened so as to enable the toner held in the hopper 11 and the supply path 12 to drop into the container 1. Since the pressure in the container 1 is lower than that in the hopper 11 and the supply path 12, the toner is sucked into the container 1. The buffering member 31 dampens the speed of the toner. The part of toner that collides with the conical surface of the buffering member 31 is dispersed around and the dispersing toner collides with the side walls of the container 1. In this way the toner is prevented from becoming lumpy by severe collisions with the inside walls of the container 1 even at the initial stage when the toner is violently sucked under a relatively large difference in pressure between inside and outside the container 1.

Since the air in the container 1 is fully expelled, the reduced speed of the toner will not adversely affect the charging of toner in the containers. Thus, the containers are densely charged with toner.

When the opening 28 is made passable, a predetermined quantity of atmospheric pressure is introduced into the low pressure chamber 20, thereby raising the pressure in the low pressure chamber 20 that surrounds the container 1. This is of particular advantage when the pressure in the container rises in accordance with the introduction of toner therein, because the pressure outside the container also rises owing to the introduction of outside air through the duct 51 until an equilibrium in pressure is reached. This protects the container 1 from being broken or deformed because of the imbalance in pressure.

When the toner in the hopper 11 is completely transferred into the container 1, the pneumatic cylinder 61 is driven so as to lower the tray 62 until the inlet neck portion 2 is withdrawn from the nozzle 24. Then, the pneumatic cylinder 70 is driven so as to separate the lower section 22 from the upper section 21. In this way the filled container 1 is taken out of the low pressure chamber 20.

Before the inlet neck portion 2 is completely separated from the nozzle 24, it is preferable to move the buffering member 31 up and down in small amplitudes through the driving mechanism 33, thereby shaking the toner off the buffering member 31 into the container 1. This prevents the remainder of toner from falling from the buffering member 31 into the low pressure chamber 20 or a fresh container 1. It also avoids any shortage of toner below a predetermined quantity.

In the example (1) the buffering member 31 functions as a valve for opening and closing the opening 28, thereby eliminating the necessity of employing a special valve such as a ball valve. This is conducive to reducing the size of the charging apparatus.

Figure 4:
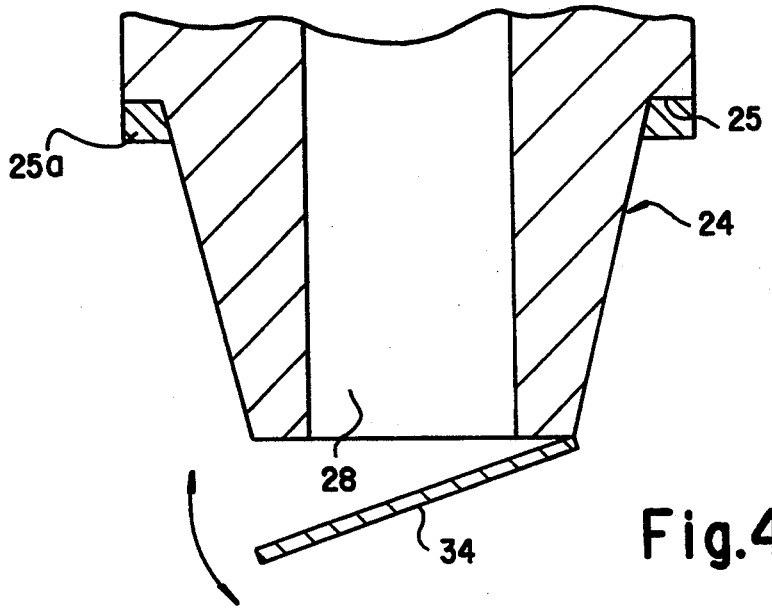
FIG. 4 is a cross-sectional view showing a cushioning device incorporated in the powder charging apparatus.

Referring to FIG. 4, a modified buffering member 34 will be described:

The modified buffering member 34 is flat, and hinged to the nozzle 24 at one end so that the flat buffering member 34 rotates in the directions of the arrows. When the toner is passed, the buffering member 34 is maintained at an incline as shown in FIG. 4 so that it dampens the falling speed of the toner from the hopper 11. The toner falling on the buffering member 34 is guided along the slant surface and drops into the container 1 (not shown in FIG. 4). The angle of incline of the buffering member 34 can be varied in accordance with the rate at which the toner is dropped into the container 1. More specifically, when there is a great difference in pressure between the hopper 11 and the container 1, the angle of incline is maintained small, and subsequently becomes large in accordance with the lessening differences in the pressure therebetween. In this way the toner is introduced into the container 1 at a constant rate. After the toner is completely transferred into the container 1, it is preferable to maintain the flat buffering member 34 in a level position so as to prevent the remainder of the toner from dropping into a fresh container and/or the low pressure chamber 20.

(EXAMPLE 2)

Figure 5:
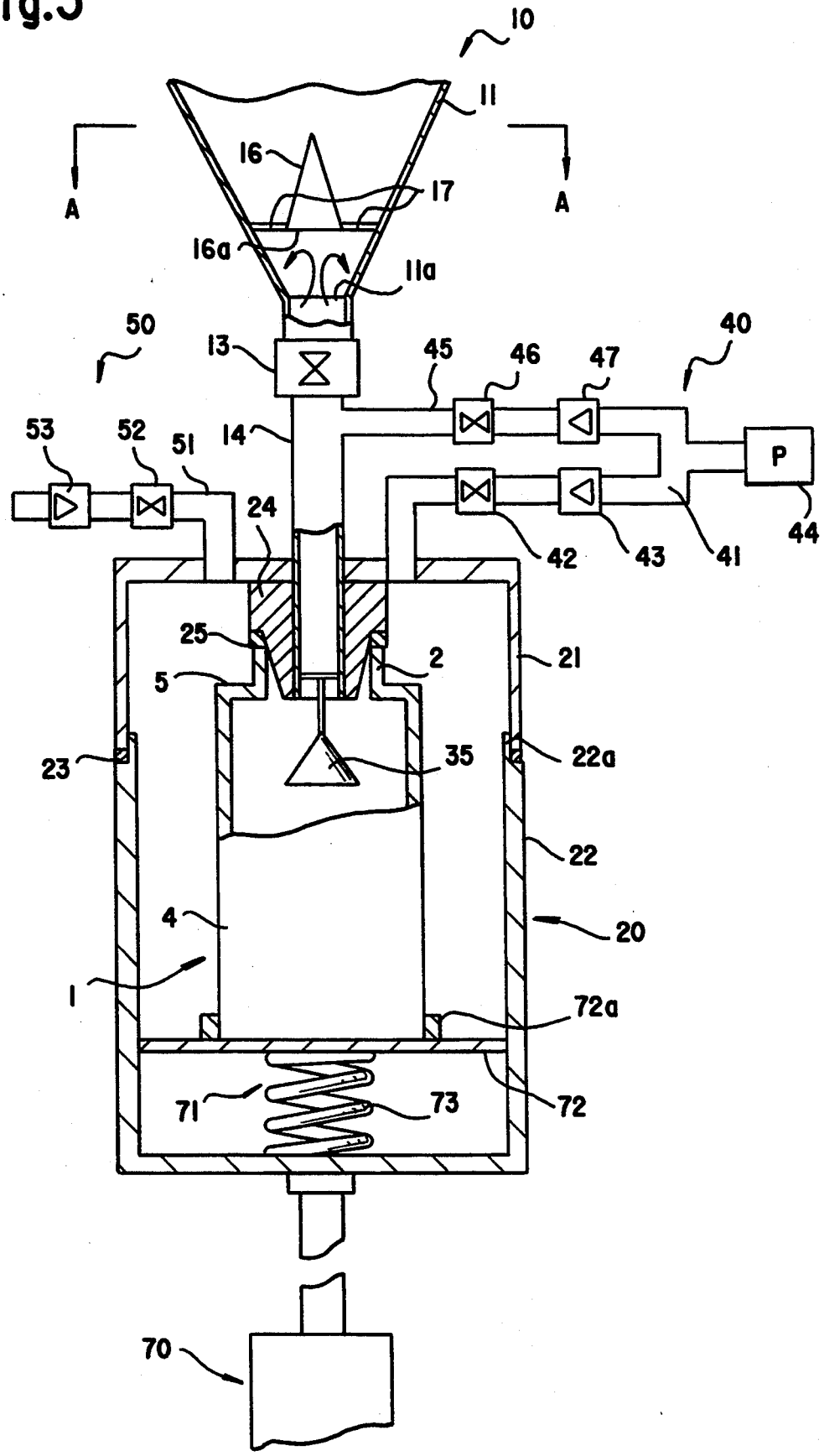
FIG. 5 is a cross-sectional view showing a modified version of the embodiment according to the present invention.
Figure 6:
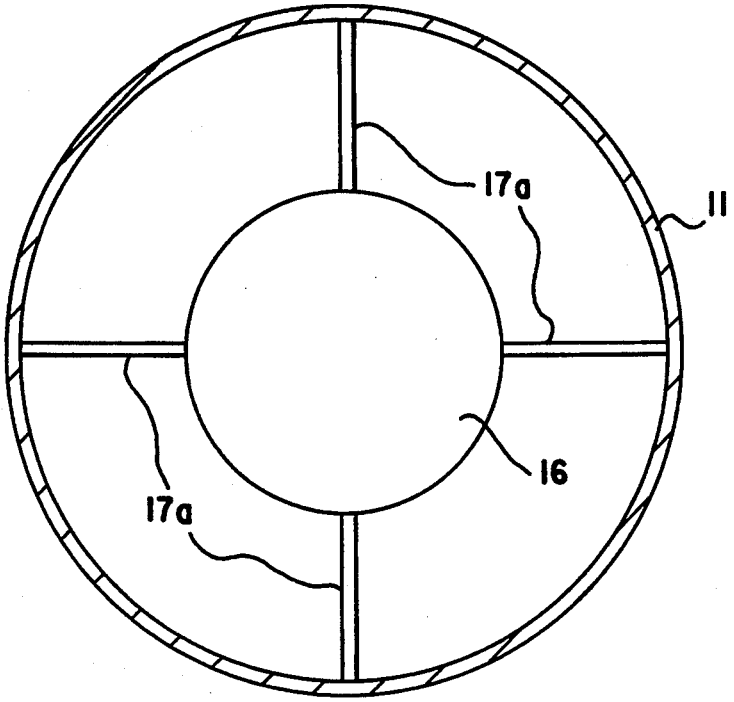
FIG. 6 is a cross-sectional view taken along the line A—A in FIG. 5.

Referring to FIGS. 5 and 6, in which like components are designated by like reference numerals to those in FIGS. 1 and 3, the powder supplier 10 and the low pressure chamber 20 are also provided.

Toner is stored in a hopper 11 including an outlet port 11*a* connected to a nozzle 24 through a supply path 14 which is closed or opened by a valve 13. The hopper 11 includes a conical guide member 16 disposed at a sufficient space from the outlet port 11*a* to allow the toner to pass through. The guide member 16 is supported by a support 17, and has a flat bottom 16*a*. As illustrated in FIG. 6, the support 17 includes several radial spokes 17*a* secured to the inner periphery of the hopper 11.

When a predetermined quantity of toner is stored in the hopper 11, the guide member 16 is buried in the toner. When the valve 13 is opened, the toner drops through the outlet port 11*a* into the nozzle 24. When air present in the toner is burst upward above the outlet port 11*a*, it rebounds off the flat bottom 16*a* as shown by the arrows.

The low pressure chamber 20 has the same structure as that of Example (1). A container 1 is raised and lowered by a pneumatic cylinder unit 71 that includes a tray 72 movable up and down along the inside wall of the low pressure chamber 20, and a spring 73 constantly biasing the tray 72 upward. The tray 72 includes a short side wall 72*a* whereby the container 1 is maintained in an upright manner on the tray 72. The lower section 22 is moved up by a pneumatic cylinder 70 with the container 1 placed on the tray 72. When the upper section 21 and the lower section 22 are connected to each other, the container 1 is biased upward by the spring 73, thereby ensuring the airtight contact between the inlet neck portion 2 and the O-ring 25.

The low pressure chamber 20 is connected to a pressure reducer 40 and a pressure riser 50 in the same manner as in Examples (1) and (2). The pressure reducer 40 includes a pump 44, a first duct 41 connected to the low pressure chamber 20, a first valve 42, a first rate adjusting valve 43, a second duct 45 connected to the powder supply path 14, a second valve 46, and a second rate adjusting valve 47. The pressure riser 50 includes a duct 51, a valve 52 and a rate adjusting valve 53.

A conical buffering member 35 is suspended concentrically with the opening 28 below the nozzle 24 by a suitable support (not numbered) secured to the inside wall of the nozzle 24.

Under this arrangement the toner is introduced into the container 1 in the following manner:

After the valve 13 is closed, a predetermined quantity of toner is placed in the hopper 11. The lower section 22 is lowered by the pneumatic cylinder 70 so as to place the container 1 on the tray 72 in an upright manner.

Then, the upper section 21 and the lower section 22 are connected to each other by driving the pneumatic cylinder 70. The container 1 confined in the low pressure chamber 20 is biased upward by the spring 73 until the inlet neck portion 2 comes into contact with the O-ring 25. At this stage, the valve 52 is closed so that the low pressure chamber 20 is sealed against the outside. The flow rates for the low pressure chamber 20 and the container 1 are previously adjusted to predetermined values by the first and second rate adjusting valves 43 and 47 so as to correspond to the respective capacities.

Under this condition the first and second valves 42 and 46 are opened, and the pump 44 is energized so as to suck the air in the low pressure chamber 20 that surrounds the container 1 through the first duct 41 at the rate determined by the first rate adjusting valve 43. At the same time, the air in the container 1 is sucked by the pump 44 through the supply path 14 and the second duct 45 at the rate determined by the second rate adjusting valve 47. The flow rates of the first and second rate adjusting valves 43 and 47 are determined so as to ensure that the pressures inside and outside the container 1 are reduced to reach an equilibrium.

When the pressures inside and outside the container 1 within the low pressure chamber 20 reach a state of vacuum, the valves 42 and 46 are closed.

Then, the valves 13 and 52 are opened. The opened valve 13 enables the toner in the hopper 11 to drop into the container 1 under the difference in pressure between the hopper 11 and the container 1. The toner in the hopper 11 flows along the inside surface of the hopper 11 toward the outlet port 11*a*, and is subjected to a stronger compressive force toward the outlet port 11*a*. The air present in the toner is strongly compressed near the toner outlet port 11*a*, and bursts upward without flowing into the toner supply path 14. The air rebounds back against the flat bottom 16*a* of the guide member 16, thereby preventing the toner remaining in the hopper 11 from dispersing upward. The conical surface of the guide member 16 allows the toner to slip off the surface, thereby ensuring that the toner is completely transferred into the container 1.

The toner falling through the nozzle 24 collides with the buffering member 35, and while slipping off the conical surface thereof, it falls into the container 1. The falling speed is dampened by the buffering member 35, thereby preventing the toner from becoming lumpy in the container. Since the pressure in the container is reduced, the toner falling in the container 1 is densely packed therein because of the absence of air. As the toner deposits in the container 1, the pressure therein increases. However, because of the equilibrium between inside and outside the container 1, the container 1 is prevented from being broken.

When the toner in the hopper 11 is wholly transferred into the container 1, the pneumatic cylinder 70 is driven to lower the lower section 22 so that the filled container 1 can be taken out of the low pressure chamber 20.

Figure 7:
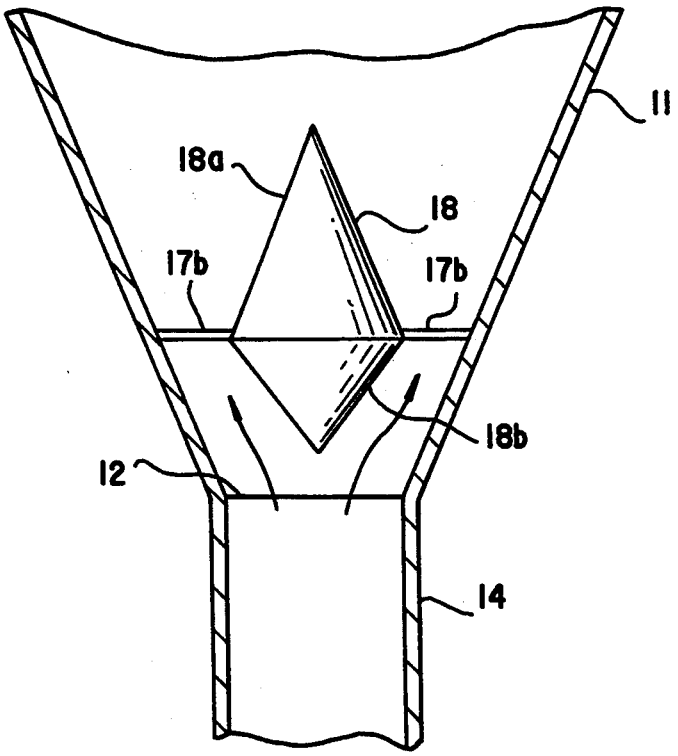
FIG. 7 is a cross-sectional view showing another example of the guide member disposed in the hopper.

Instead of the conical guide member 16, a modified guide member 18 can be used, which has an upper conical portion 18*a* and a lower conical portion 18*b* unlike the flat bottom 16*a* of the guide member 16. The guide member 18 is maintained by supports 17*b*. The lower conical portion 18*b* is effective to dampen the violent flow of air burst from below in the directions of the arrows in FIG. 7. Thus, a turbulent flow of air is avoided near the toner outlet port 11*a*, thereby ensuring a smooth flow of toner into the supply path 14.

(EXAMPLE 3)

Figure 8:
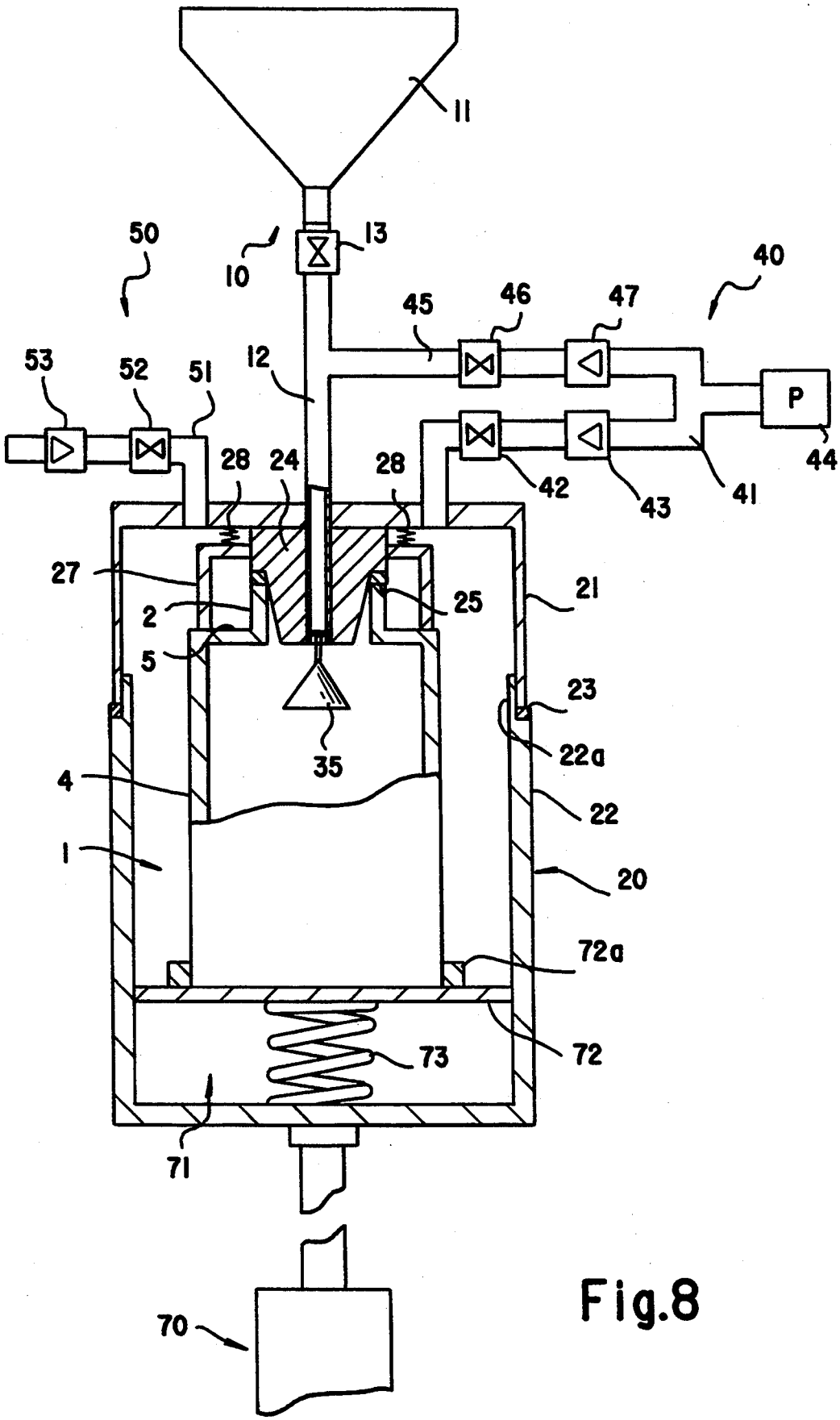
FIG. 8 is a cross-sectional view showing a third modified example of the embodiment according to the present invention.

Referring to FIG. 8, in which like components are designated by like reference numerals to those shown in FIGS. 1, 3 and 5, the nozzle 24 is provided with a cylindrical cover 27 suspended from the ceiling of the upper section 21 by compressive springs 28 so that the cover 27 is vertically displaceable so as to absorb the upward movement of the container 1. Unless the inlet neck portion 2 of the container 1 is engaged with the nozzle 24, the open end of the cover 27 is located at a lower position than the shoulder portion 5 of the container 1 which is not raised. As the container 1 is raised, the shoulder portion 5 of the container 1 comes into engagement with the cover 27. The total spring constant of the springs 28 is smaller than that of the spring 73.

The other structures are the same as those of Example (2), and their description it will be omitted.

In Example (3), when the inlet neck portion 2 is placed in engagement with O-ring 25, the toner sticking to the outside surface of the nozzle 24 is scraped by the inlet neck portion 2 and the falling toner deposits on the shoulder portion 5. The deposit of toner is covered against the neck portion 2 by the cover 27. At this stage, the container 1 and the low pressure chamber 20 are evacuated, and then the pressure in the low pressure chamber 20 surrounding the container 1 is increased, and the supply of toner is initiated. When air is introduced into the low pressure chamber 20 through the duct 51, the cover 27 prevents the toner depositing on the shoulder portion 5 from dispersing into the low pressure chamber 20. The cover 27 is advantageous in protecting the inside of the low pressure chamber 20 from becoming stained with toner.

(EXAMPLE 4)

Figure 9:
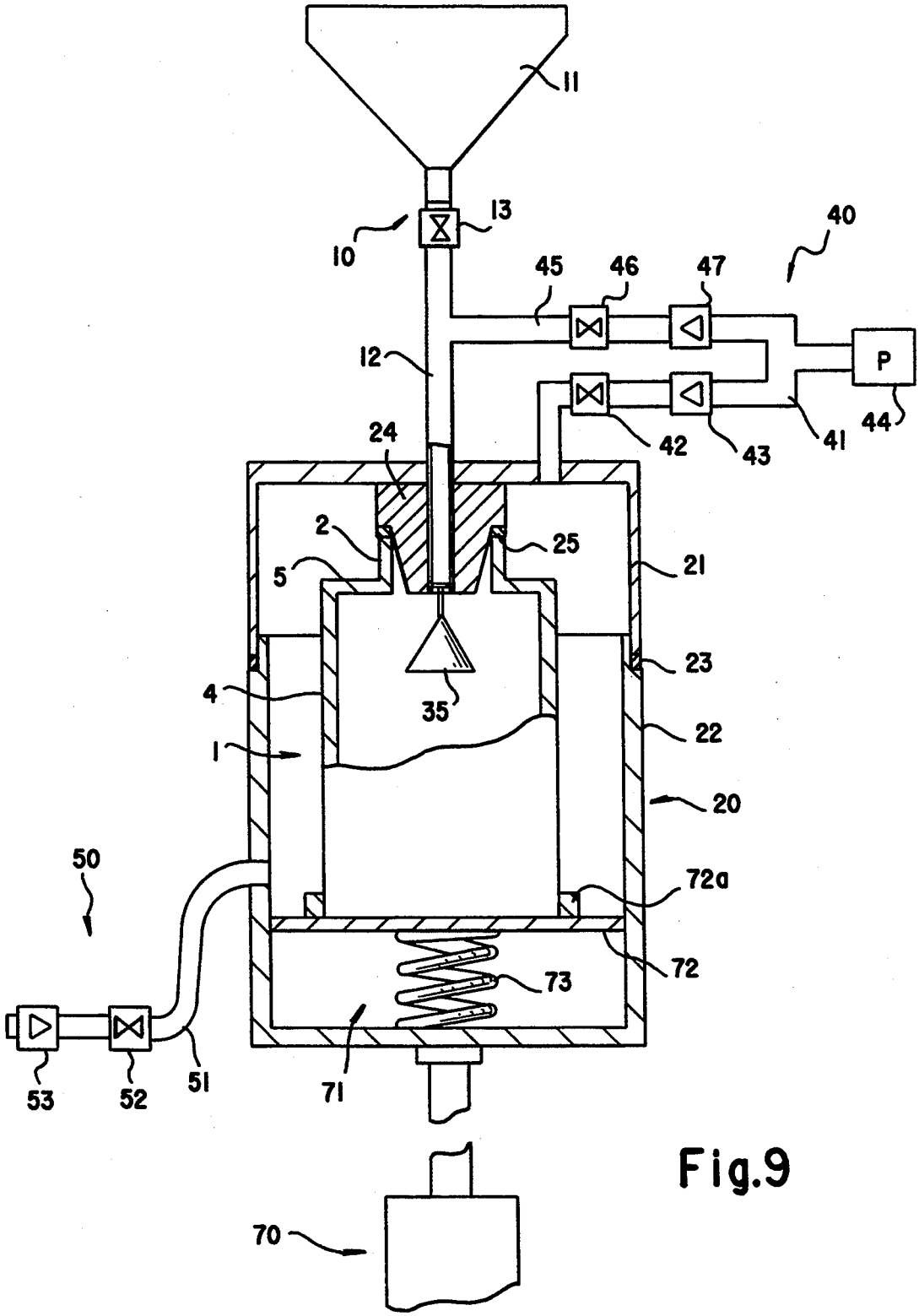
FIG. 9 is a cross-sectional view showing a fourth modified example of the embodiment according to the present invention.
Figure 10:
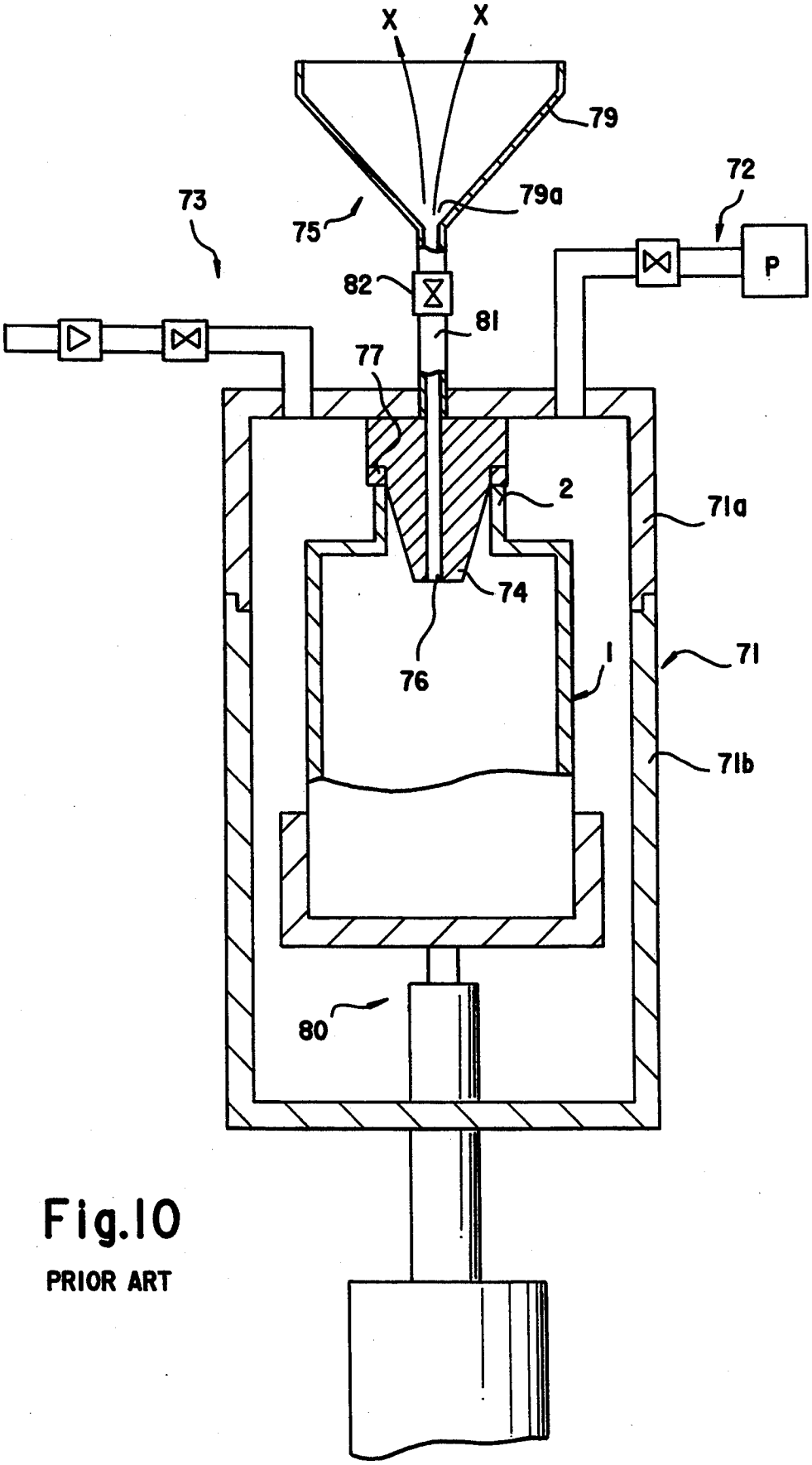
Fig.10 PRIOR ART
FIG. 10 is a cross-sectional view showing a conventional powder charging apparatus.
Figure 11:
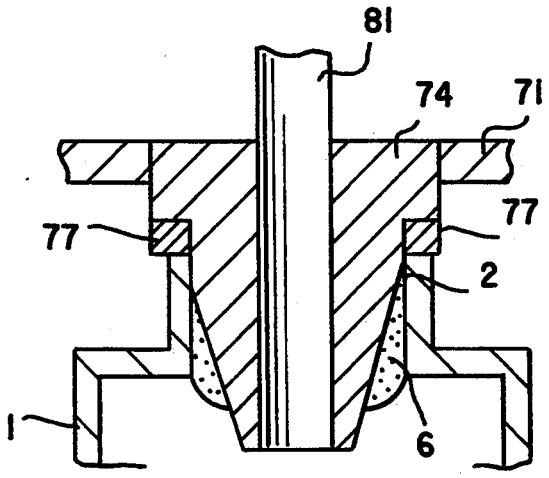
Fig.11 PRIOR ART
FIG. 11 is a cross-section on an enlarged scale showing a main portion of the known powder charging apparatus.

Referring to FIG. 9, in which like components are designated by like reference numerals to those in FIGS. 1, 3, 5 and 8, the duct 51 of the pressure riser 50 is attached to a lower part of the lower section 22 so as to prevent any toner deposited on the shoulder portion 5 from dispersing when the pressure in the low pressure chamber 20 is increased with the supply of air through the duct 51. The other structures are the same as those of Example (2) shown in FIG. 5. The duct 51 is preferably made of a flexible tube so as not to prevent the movement of the lower section 22.

Throughout Examples (1) to (4) the toner stored in the hopper 11 is supplied into the container 1 at one time, but it is possible to supply half of the total quantity into the container 1 and retain the other half in the hopper 11, which is supplied at the next stage. Alternatively, it is possible to divide the toner in the hopper into more doses and supply dose by dose. In these cases, since the container 1 and the low pressure chamber 20 can be maintained at a higher pressure than when the toner is supplied at one time, the toner is prevented from becoming lumpy in the container 1. In addition, the first dose of toner functions as a cushion for subsequent dosage, thereby preventing the toner from becoming lumpy in the container 1.

It is understood that various other modifications will be apparent to and can be readily made by those skilled in the art without departing from the scope and spirit of this invention. Accordingly, it is not intended that the scope of the claims appended hereto be limited to the description as set forth herein, but rather that the claims be construed as encompassing all the features of patentable novelty that reside in the present invention, including all features that would be treated as equivalents thereof by those skilled in the art to which this invention pertains.

What is claimed is:

1. A powder charging apparatus comprising:

a low pressure chamber for accommodating a container to be charged with powder, the low pressure chamber being separable into an upper section and a lower section, and the container having an inlet neck portion;

a pressure reducer for reducing the pressures in the low pressure chamber and the container at the same time;

a pressure riser for increasing the pressure in the low pressure chamber;

a powder supplier for allowing a predetermined quantity of powder to fall into the container under a difference in the pressures between inside and outside the container, the powder supplier includes a hopper including an outlet port;

a nozzle secured to the low pressure chamber, the nozzle having a first end connected to the outlet port of the hopper and a second end inside the low pressure chamber, and an inner diameter of an axial bore of the nozzle being constant; and a buffering means for dampening a speed at which the powder is dispersed from the second end of the nozzle, said buffering means having a conical shape with a surface thereof diverging downward, the buffering means being movable relative to opening of the second end of the nozzle so as to open and close the second end, and a top of the buffering means, disposed in the second end of the nozzle, for closing said container airtightly when the buffering means is positioned to close an opening at the second end.

2. A powder charging apparatus according to claim 1, wherein the powder is toner.

3. A powder charging apparatus according to claim 1, wherein the buffering means is provided at a lower end of a stem which inserts through the nozzle and the hopper.

4. A powder charging apparatus according to claim 3, wherein the stem is moved up and down by a driving mechanism which is positioned over an axial center of the hopper.

* * * * *